US009429010B2

(12) United States Patent
Winters et al.

(10) Patent No.: US 9,429,010 B2
(45) Date of Patent: Aug. 30, 2016

(54) METHODS AND SYSTEMS FOR TESTING THE INTEGRITY OF COMPONENTS OF A HYDROCARBON WELL SYSTEM

(71) Applicants: Warren Winters, Cypress, TX (US); Ronald Livesay, Fort Worth, TX (US); Stephen Edwards, Hockley, TX (US); Jim McKay, Houston, TX (US)

(72) Inventors: Warren Winters, Cypress, TX (US); Ronald Livesay, Fort Worth, TX (US); Stephen Edwards, Hockley, TX (US); Jim McKay, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 563 days.

(21) Appl. No.: 13/899,064

(22) Filed: May 21, 2013

(65) Prior Publication Data

US 2013/0311093 A1 Nov. 21, 2013

Related U.S. Application Data

(60) Provisional application No. 61/799,041, filed on Mar. 15, 2013, provisional application No. 61/649,653, filed on May 21, 2012.

(51) Int. Cl.

| | |
|---|---|
| ***E21B 47/06*** | (2012.01) |
| ***E21B 47/00*** | (2012.01) |
| ***E21B 33/064*** | (2006.01) |
| ***E21B 33/035*** | (2006.01) |

(52) U.S. Cl.

CPC ..... *E21B 47/06* (2013.01); *E21B 33/0355* (2013.01); *E21B 33/064* (2013.01); *E21B 47/0001* (2013.01)

(58) Field of Classification Search

CPC ..... E21B 47/06
USPC ..... 702/6
See application file for complete search history.

(56) References Cited

U.S. PATENT DOCUMENTS

| | | | | |
|---|---|---|---|---|
| 7,706,980 | B2 | 4/2010 | Winters et al. | |
| 9,175,539 | B2 * | 11/2015 | Livesay | E21B 33/0355 |
| 2005/0269079 | A1 | 12/2005 | Franklin | |
| 2013/0311097 | A1 * | 11/2013 | Livesay | E21B 33/0355 702/11 |

FOREIGN PATENT DOCUMENTS

| | | | |
|---|---|---|---|
| EP | 1270870 | A1 | 1/2003 |

OTHER PUBLICATIONS

PCT/US2013/042019 International Search Report and Written Opinion dated Jul. 4, 2014 (7 p.).

* cited by examiner

*Primary Examiner* — Bryan Bui
(74) *Attorney, Agent, or Firm* — John Poliak

(57) ABSTRACT

A component of the hydrocarbon well system and a first supply line to the component can be isolated from other components of the hydrocarbon well system. The component and the first supply line can be pressurized to a test pressure with a test fluid. Then, a pressure and a temperature of the test fluid in the component that was pressurized can be measured over a period of time. The pressure and the temperature that were measured can be analyzed and a pressure integrity of the component can be determined based on the analysis.

41 Claims, 15 Drawing Sheets

METHODS AND SYSTEMS FOR TESTING THE INTEGRITY OF COMPONENTS OF A HYDROCARBON WELL SYSTEM

CROSS REFERENCE TO RELATED APPLICATION

This application claims priority to U.S. Provisional Patent Application Ser. No. 61/799,041 filed on Mar. 15, 2013 and U.S. Provisional Patent Application Ser. No. 61/649,653 filed on May 21, 2012, the disclosures of which are incorporated by reference herein in their entirety.

FIELD

This disclosure relates generally to testing well systems.

DESCRIPTION OF THE RELATED ART

Safety is a consideration in the operation of hydrocarbon well systems, especially off-shore wells. Regulations exist that require testing of well systems to ensure that the well systems are operating properly. Current regulations require that the components of the well systems, such as the blowout preventers and the well casings, be tested regularly to ensure that the components are operating properly and not leaking. In typical testing, the choke line and an isolated component of the well system, for example, a portion of the blowout preventer, are pressurized. The change in pressure is then monitored to determine if the change in pressure reaches a steady state, thus indicating that the component is not leaking.

This approach, however, presents several problems. In typical tests, the monitored change in the pressure includes both a change in pressure due to the choke line and the change in pressure due to the component of the well system. The choke line's contribution, however, can make it difficult to determine whether the change in pressure has reached a steady state. This is due to several factors. For example, the entire length of the choke line resides in highly varying environmental conditions, from the surface of the ocean to deep subsea conditions. These conditions introduce temperature and pressure effects, which alter the choke line's contribution to the change in pressure during the pressure testing. These effects become more of a factor as the requirements for verifying a steady state in the pressure change, i.e. a non-leaking condition, become more rigorous.

Thus, there is need of a process by which components of a well system can be tested for pressure integrity that accounts for the contribution of the supply lines to the change in pressure during the pressure tests.

SUMMARY

Implementations of the present teachings relate to systems and methods for testing the pressure integrity of different components of a well system. According to implementations, a component of a well system can be tested by isolating the component of the well system, such as the wellhead or portions of the blowout preventer stack. Once isolated, the component of the well system can be pressurized to a test pressure via one or more supply lines connected to the component of the well system, e.g. a choke line and a kill line.

Once pressurized to the test pressure, the one or more supply lines can be isolated from the component of the well system. Then, the changes in pressure and temperature can be measured in the component of the well system. By isolating the component of the well system under test, the supply lines' contribution to the change in pressure can be removed and an accurate change in pressure and temperature for the component of the well system can be obtained. Then, the changes in pressure and temperature for the component of the well system can be analyzed to determine if the component of the well system is maintaining pressure integrity, i.e. leaking or not leaking.

In implementations, a computer-implemented method for testing components of a hydrocarbon well system is disclosed. The method can comprise isolating a component of the hydrocarbon well system and a first supply line to the component from other components of the hydrocarbon well system; pressurizing the component and the first supply line to a test pressure with a test fluid; measuring a pressure and a temperature of the test fluid in the component that was pressurized over a period of time; analyzing, by a processor, the pressure and the temperature that were measured; and determining that a pressure integrity of the component based on the analyzing.

In implementations, a device is disclosed. The device can comprise one or more processors; and a non-transitory computer readable medium comprising instructions that cause the one or more processors to perform a method testing components of a hydrocarbon well system, the method comprising: isolating a component of the hydrocarbon well system and a first supply line to the component from other components of the hydrocarbon well system; pressurizing the component and the first supply line to a test pressure with a test fluid; measuring a pressure and a temperature of the test fluid in the component that was pressurized over a period of time; analyzing the pressure and the temperature that were measured; and determining that a pressure integrity of the component based on the analyzing.

In implementations, a non-transitory computer readable storage medium comprising instructions that cause one or more processors to perform a method testing components of a hydrocarbon well system. The method can comprise isolating a component of the hydrocarbon well system and a first supply line to the component from other components of the hydrocarbon well system; pressurizing the component and the first supply line to a test pressure with a test fluid; measuring a pressure and a temperature of the test fluid in the component that was pressurized over a period of time; analyzing the pressure and the temperature that were measured; and determining that a pressure integrity of the component based on the analyzing.

In implementations, a well system is disclosed. The well system can comprise a blowout preventer stack positionable within a borehole and comprising a plurality of sealing members that can be actuated between an open position and a closed position around the borehole; one or more supply lines in fluid communication with the blowout preventer stack; one or more temperature sensors and one or more pressure sensors arranged in the borehole to measure a temperature and a pressure, respectively, of a test area in the borehole; a computer in communication with one or more elements of the blowout preventer stack and the one or more temperature and pressure sensors, wherein the computer comprises one or more processors and a non-transitory computer readable medium comprising instructions that cause the one or more processors to perform a method for testing components of a well system, the method comprising: isolating a component of the well system and a first supply line to the component from other components of the well system; pressurizing the component and the first supply line to a test pressure with a test fluid; measuring a pressure and a temperature of the test fluid in the component that was pressurized over a period of time; analyzing the pressure and the temperature that were measured; and determining that a pressure integrity of the component based on the analyzing.

BRIEF DESCRIPTION OF THE DRAWINGS

Various features of the implementations can be more fully appreciated, as the same become better understood with reference to the following detailed description of the implementations when considered in connection with the accompanying figures, in which.

DETAILED DESCRIPTION

For simplicity and illustrative purposes, the principles of the present teachings are described by referring mainly to exemplary implementations thereof. However, one of ordinary skill in the art would readily recognize that the same principles are equally applicable to, and can be implemented in, all types of information and systems, and that any such variations do not depart from the true spirit and scope of the present teachings. Moreover, in the following detailed description, references are made to the accompanying figures, which illustrate specific exemplary implementations. Electrical, mechanical, logical and structural changes may be made to the exemplary implementations without departing from the spirit and scope of the present teachings. The following detailed description is, therefore, not to be taken in a limiting sense and the scope of the present teachings is defined by the appended claims and their equivalents.

Figure 1:
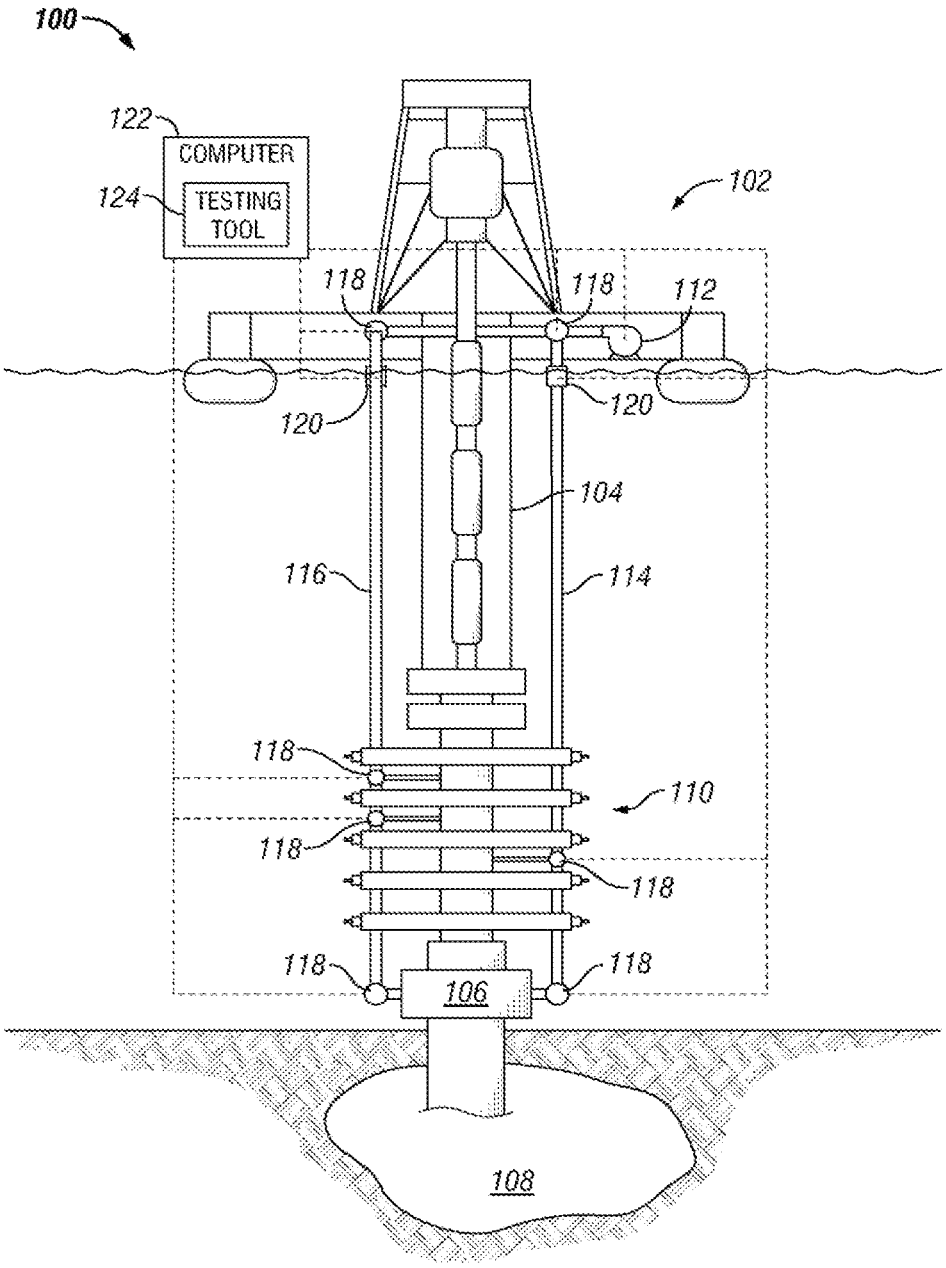
FIG. 1 is a generalized schematic diagram of a hydrocarbon well system, according to aspects of the present disclosure.

FIG. 1 illustrates an example of a hydrocarbon well system ("well system") 100 in which aspects of the disclosure can be performed. While FIG. 1 illustrates various components contained in the well system 100, one skilled in the art will realize that FIG. 1 is exemplary and that additional components can be added and existing components can be removed.

As illustrated in FIG. 1, the well system 100 can include a rig 102 that is coupled to a riser 104 and a wellhead 106 for extracting hydrocarbons, for example oil and/or gas, from a reservoir 108. The well system 100 can include a blowout preventer ("BOP") stack 110. The BOP stack 110 can include a series of valves 118 that can be closed in the event that the rig 102 loses control of fluids within the well system 100. Likewise, the series of valves 118 within the BOP stack 110 can be opened and closed to perform other processes such as testing, maintenance, etc.

The well system 100 can also include a high pressure pump 112. The high pressure pump 112 can be coupled to the riser 104, the wellhead 106, and/or the BOP stack 110 by fluid supply lines, e.g. a choke line 114 and a kill line 116. During operation, the high pressure pump 112 can pump fluid down the kill line 116, which is returned via the choke line 114, in order to maintain pressure within the well system 100. Additionally, according to aspects of the disclosure, the high pressure pump 112, the choke line 114, and the kill line 116 can be utilized to perform pressure integrity tests on the components of the well system 100 as described below. To control the flow of fluid to the components of the well system 100, the choke line 114 and the kill line 116 can include the number of valves 118 that can be opened and closed to regulate the flow of fluid in the choke line 114 and the kill line 116. Likewise, the choke line 114 and the kill line 116 can include a number of pressure and temperature sensors 120 to measure the pressure of the fluid in the choke line 114 and the kill line 116.

To control the operation of the well system 100, the rig 102 can include a computer 122. The computer 122 can be electrically coupled to the components of the well system 100, such as the control systems of the BOP stack 110, the pump 112, the valves 118, the pressure and temperature sensors 120, and other control systems and sensors. The computer 122 can be electrically coupled to the components of the well system 100 using any type of known wired or wireless electrical communication pathways in order to control the operation of the components and receive data representing the operation of the well system 100.

According to aspects, the computer 122 can include a testing tool 124. The testing tool 124 can be configured to instruct the computer 122 to communicate with the components of the well system 100 to perform pressure integrity tests on the components of the well system 100. The testing tool 124 can be configured as an software program that is capable of being stored on and executed by the computer 122. Likewise, the testing tool 124 can be configured as a software module that is part of other application programs executing on the computer 122. In any example, the testing tool 124 can be written in a variety of programming languages, such as JAVA, C++, Python code, Visual Basic, HTML, XML, and the like to accommodate a variety of operating systems, computing system architectures, etc.

According to aspects, the computer 122 can be configured to execute the testing tool 124 to perform the pressure integrity testing on components of the well system 100. To perform pressure integrity testing, the computer 122 can isolate a component of a well system 100, such as the wellhead 106 or portions of the BOP stack 110. Once isolated, the computer 122 can pressurize, utilizing the high pressure pump 112, the component of the well system 100 and the supply lines, e.g. a choke line 114 and a kill line 116, to a test pressure.

Once pressurized to the test pressure, the computer 122 can isolate the supply lines, e.g. the kill line 116 and the choke line 114 from the component of the well system 100 by closing the valves 118 for the kill line 116 and the choke line 114. Then, the computer 122 can measure the changes in pressure and temperature in the component of the well system. Once measured, the computer 122 can analyze the changes in pressure and temperature for the component of the well system 100, without the contribution from the choke line 114 and the kill line 116, to determine if the component of the well system 100 is maintaining pressure integrity, i.e. leaking or not leaking. By isolating the choke line 114 and the kill line 116, the choke line's 114 and the kill line's 116 contributions to the change in pressure and temperature measured for the component of the well system 100 can be removed. Thereby, the computer 122 can obtain accurate changes in pressure and temperature for the component of the well system 100 that does not include the contribution of the choke line 114 and the kill line 116.

While FIG. 1 illustrates one example of a well system 100 including a BOP stack 110, one skilled in the art will realize that this is one example and the implementations of the disclosure described herein can be utilized with any type of well system and BOP stack. For example, the well system 100 and BOP stack 110 can include different components and can be arranged in different configurations. Moreover, while implementations of the disclosure are described herein with reference to the choke line 114 and the kill line 116, one skilled in the art will realize that process and procedures described herein can be performed on any types of pressure supply lines within a well system.

Figure 2:
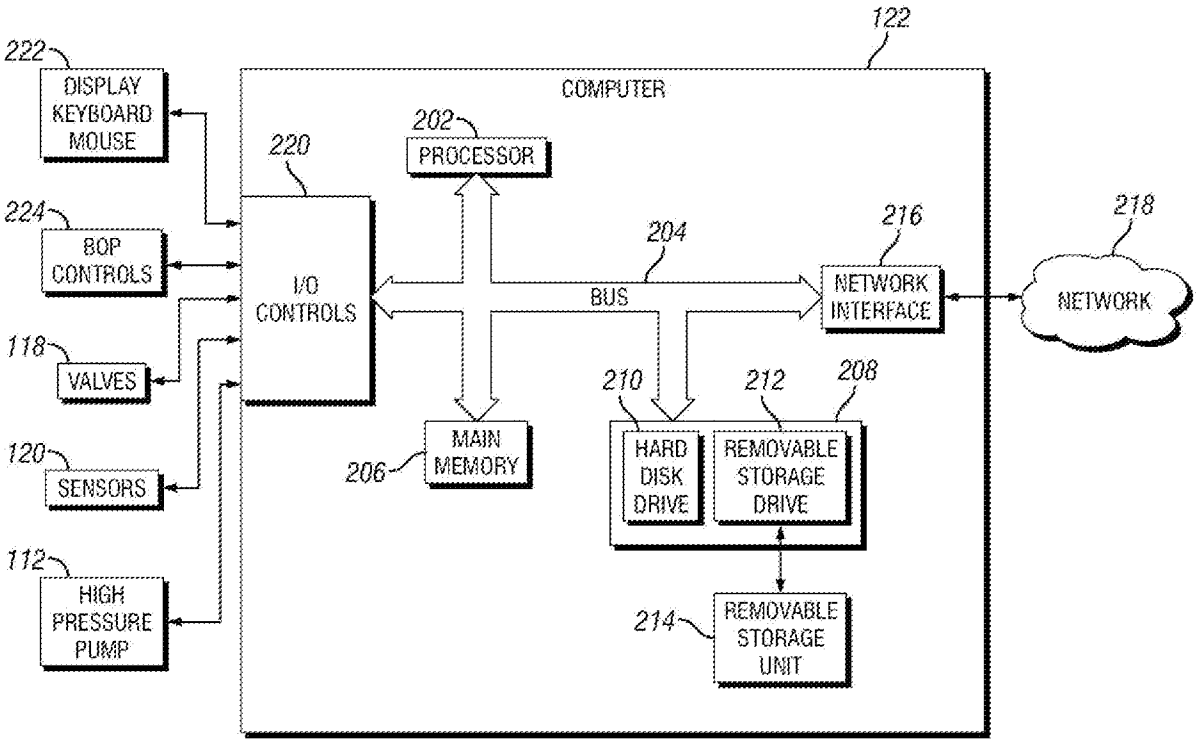
FIG. 2 is a generalized schematic diagram of a computer that includes a testing tool, according to aspects of the present disclosure.

FIG. 2 is a general schematic diagram of the computer 122 that can be utilized to perform the pressure integrity testing, according to aspects of the disclosure. In aspects, the testing tool 124 can be stored and executed on the computer 122 in order to perform the process described below. While FIG. 2 illustrates various components contained in the computer 122, one skilled in the art will realize that FIG. 2 is exemplary and that additional components can be added and existing components can be removed.

As shown in FIG. 2, the computer 122 can include one or more processors, such as a processor 202, which can provide an execution platform for implementations of the testing tool 124. Commands and data from the processor 202 are communicated over a communication bus 204. The computer 122 can also include a main memory 206, for example, one or more computer readable storage media such as a Random Access Memory (RAM), where the testing tool 124 and/or other software programs, such as an operating system (OS) can be stored and executed during runtime. The computer 122 can also include a secondary memory 208. The secondary memory 208 can include, for example, one or more computer readable storage media or devices such as a hard disk drive 210 and/or a removable storage drive 212, representing a floppy diskette drive, a magnetic tape drive, a compact disk drive, etc., where a copy of the software program implementation for the testing tool 124 and/or other software programs, such as the OS, can be stored. The removable storage drive 212 reads from and/or writes to a removable storage unit 214 (e.g., magnetic media, optical media, solid-state memory devices, etc.) in a well-known manner. The computer 122 can also include a network interface 216 in order to connect with any type of network 218, whether wired or wireless.

The computer 122 can also include one or more input/output interfaces 220 coupled to the communications bus 204. The one or more input/output interfaces 220 can be any type of conventional input/output interfaces, such as Universal Serial Bus ("USB"), Firewire™, Bluetooth™, serial interfaces, parallel interfaces, graphics interfaces, and the like. In implementations, a user can interface with the computer 122 and operate the testing tool 124 with one or more input/output devices 222 coupled to the input/output interfaces 220, such as a display, keyboard, mouse, etc.

In aspects, BOP controls 224, the valves 118, the sensors 120, and the high pressure pump 112 can be coupled to the input/output interfaces 220. To perform the pressure integrity testing, the testing tool 124 can be configured to instruct the computer 122 to communicate with the BOP controls 224, the valves 118, the sensors 120, and the high pressure pump 112 via the input/output interfaces 220.

Figure 3:
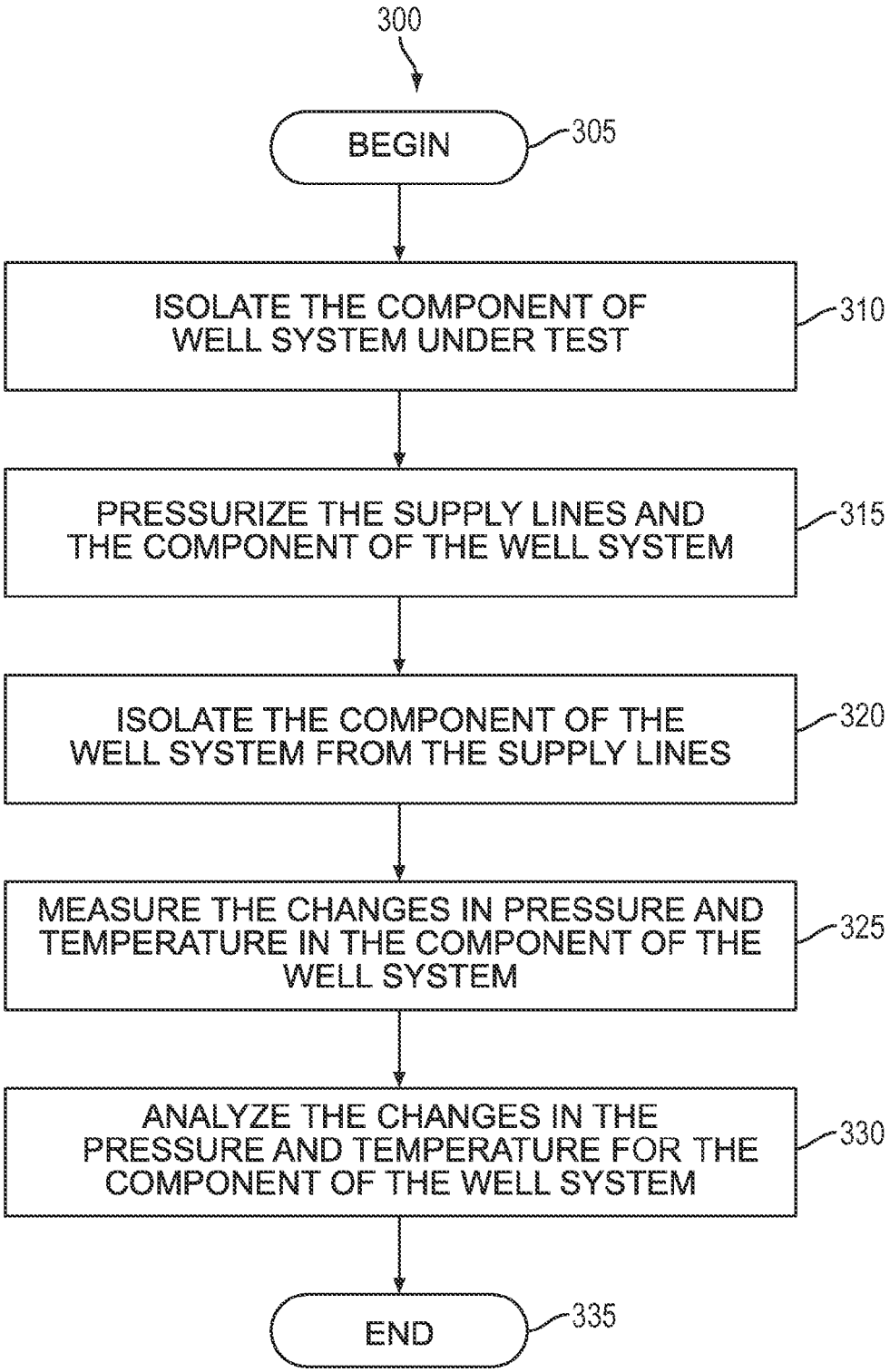
FIG. 3 is a flowchart that illustrates an example of a process for testing the pressure integrity of components of a well system, according to aspects of the present disclosure.
Figure 4A:
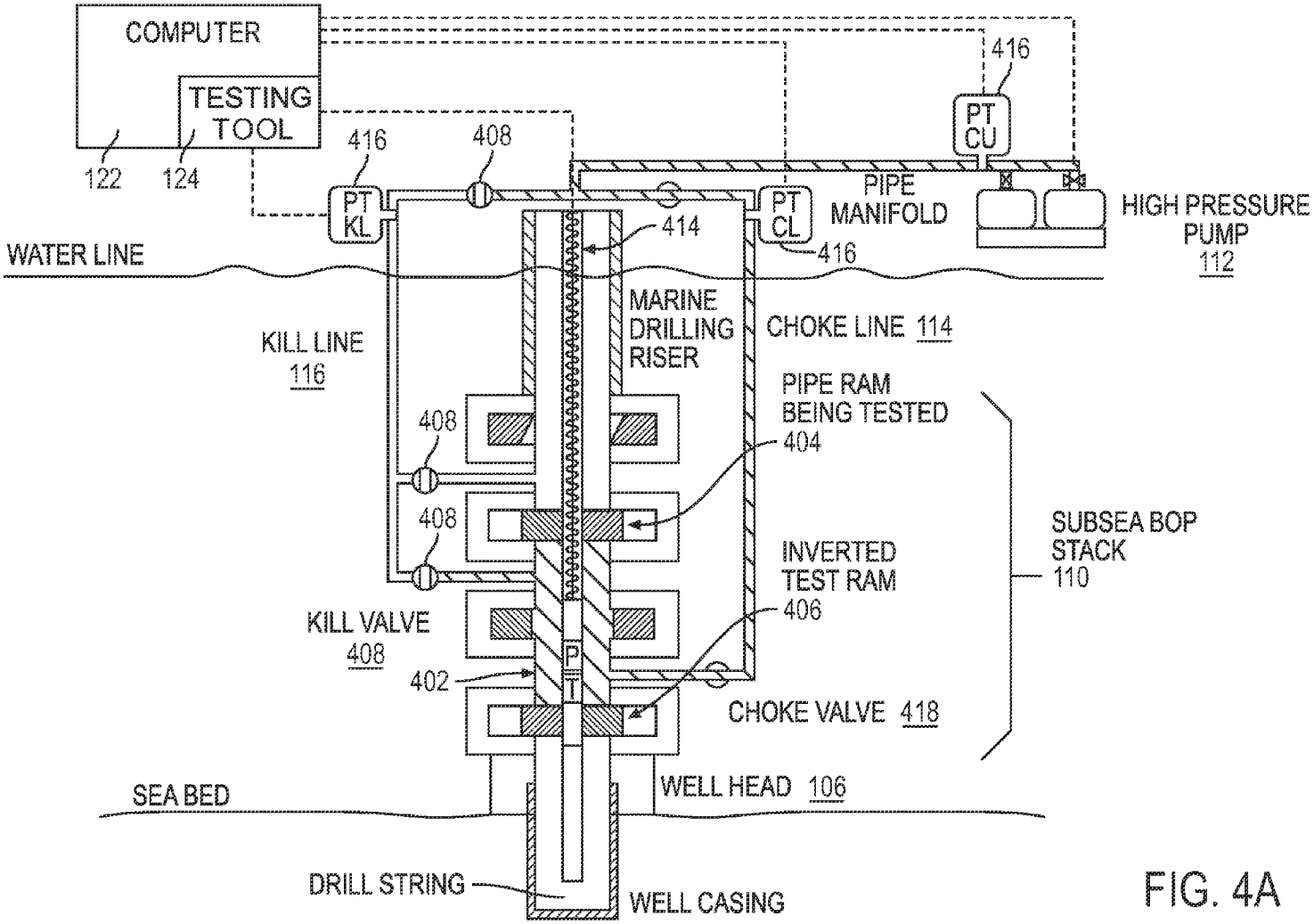
FIGS. 4A and 4B are generalized schematic diagrams that illustrate examples of a testing process, according to aspects of the disclosure.
Figure 4B:
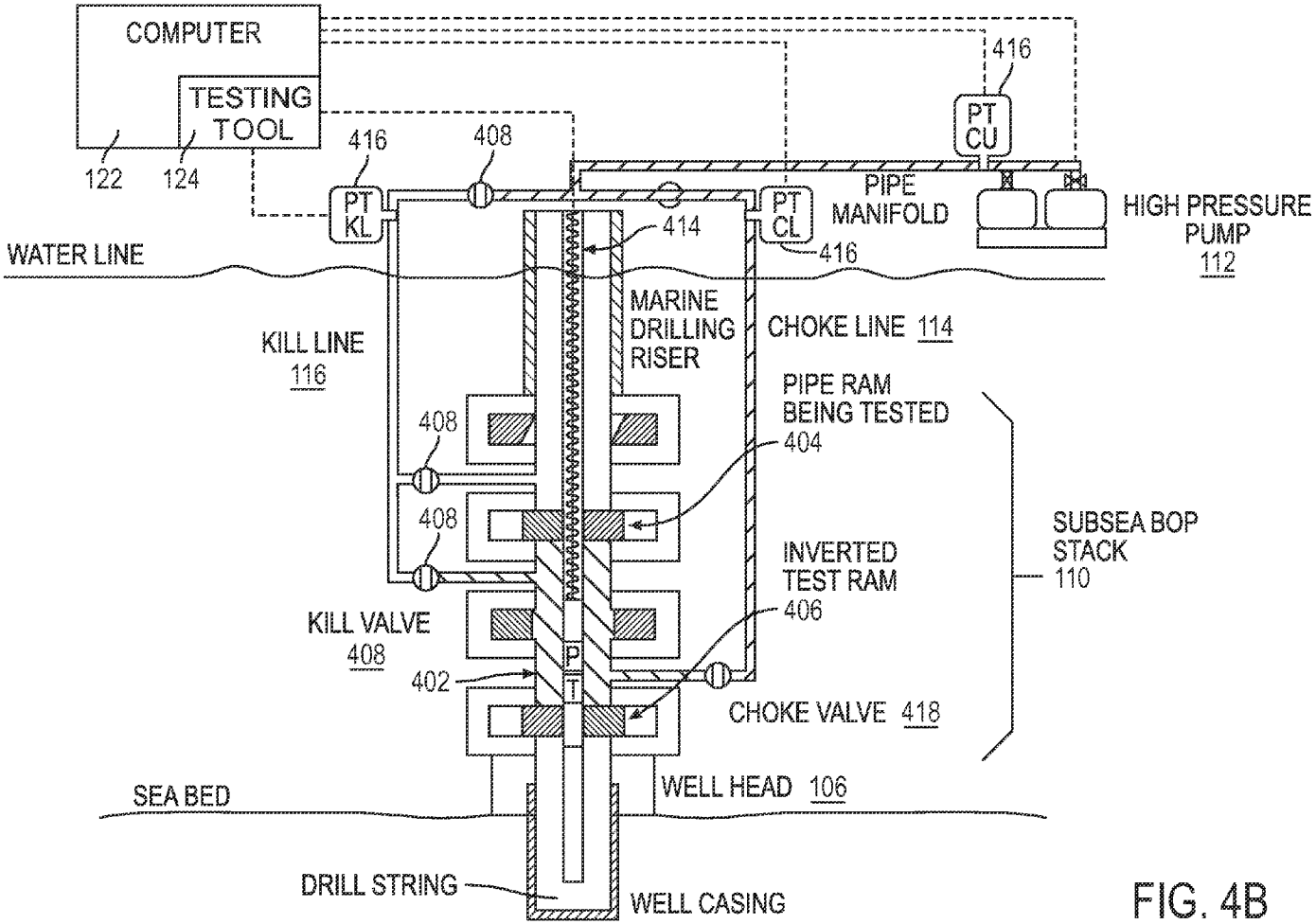

As described above, the computer 122, executing the testing tool 124, can perform pressure integrity testing on the components of the well system 100. FIG. 3 is a flow diagram that illustrates an exemplary process 300 for testing components of the well system 100, for example, testing a portion of the BOP stack 110 as illustrated in FIGS. 4A and 4B. While FIGS. 4A and 4B illustrate only a portion of well system 100 necessary to describe the process 300, one skilled in the art will realize that well system 100 can include any known components of a well system, for example, the components illustrated in FIG. 1.

In 305, the process can begin. For example, as illustrated in FIGS. 4A and 4B, a user can desire to test the pressure integrity of a portion 402 of the BOP stack 110, e.g. the pipe ram 404. For instance, a user operating the testing tool 124 on the computer 122 can initiate the pressure integrity testing on the portion 402 of the BOP stack 110. Likewise, for instance, the computer 122, executing the testing tool 124, can be configured to automatically initiate the pressure integrity testing on the portion 402 of the BOP stack 110, whether at a defined time or periodically.

In 310, the computer 122 can isolate the component of the well system 100 under test. For example, as illustrated in FIG. 4A, the computer 122, executing the testing tool 124, can communicate with the BOP controls 224 to close a pipe ram 404 and an inverted test ram 406 in the BOP stack 110 and a kill valves 408. By closing the pipe ram 404, the inverted test ram 406 in the BOP stack 110 and the kill valves 408, the portion 402 of the BOP stack 110 can be isolated from the remainder of the BOP stack 110.

In this example, prior to isolation, a telemetry-equipped drill string 410 can introduced to the well system 100. The drill string 410 can be fitted with sensor subs 412, for example pressure and temperature sensors for measuring external pressure and external temperature. The pressure sensor and temperature sensor of the sensor sub 412 can be positioned nearest the inverted test ram 406 to be within each component, e.g. BOP cavity, that is pressure tested. The computer 122 can be coupled to the sensor subs 412 by any type of wired or wireless communication hardware, for example, a wire 414 within the drill string 412. The drill string 410 can be any type of known telemetry-equipped drill strings such as those marketed or currently under development by IntelliServ Inc. (IntelliPipe®), XACT Downhole Telemetry Inc. and VAM (Vallourec and Mannesmann) Services. In addition to the sensor subs 412, one or more pressure and temperature sensors 416 can be included in the pipe manifold, choke line 114 and the kill line 116.

In 315, the computer 122 can pressurize one or more of the supply lines and the component of the well system 100. For example, as illustrated in FIG. 4A, the computer 122, executing the testing tool 124, can communicate with the high pressure pump 112 to pressurize the choke line 114 and the portion 402 of the BOP stack 110 to a test pressure. In implementations, the choke line 114, the portion 402 can be pressurized to a pressure adequate to test the portion 402 while maintaining safe operating pressures in the well system 100.

In 320, the computer 122 can isolate one or more of supply lines from the component of the well system 100. For example, as illustrated in FIG. 4B, the computer 122, executing the testing tool 124, can close choke valve 418. By closing the choke valve 418, the choke line 114 can be isolated from the portion 402 of the BOP stack 110, thereby isolating the portion 402.

In 325, the computer 122 can measure the changes in pressure and temperature from the test pressure and the initial temperature in the component of the well system 100 over the period of time. For example, as illustrated in FIG. 4B, the computer 122, executing the testing tool 124, can communicate with sensor subs 412 to measure the changes in the pressure and temperature in portion 402. In implementations, the period of time for which the change in pressure is measured can be any adequate time period to determine if the change in pressure reaches a steady state, any adequate time period to extrapolate whether the change in pressure will reach a steady state, and/or any time period to acquire enough pressure and temperature readings to determine the pressure integrity of the portion 402.

In 330, the computer 122 can analyze the changes in pressure and temperature for the component of the well system 100. For example, the computer 122, executing the testing tool 124, can perform any type of data analysis and/or fitting to determine whether the changes in pressure and temperature in the portion 402 indicate pressure integrity in the portion 402.

For example, when changes in temperature and pressure within the pressurized test volume are measured, the changes in temperature and pressure can be analyzed to determine pressure integrity. In correlating temperature versus pressure, a significant departure of pressure changes from the expected linear relation to temperature changes is a possible indicator of leak behavior. Pressure change can be determined by knowing the state equation of the fluid in a test volume. Alternatively, the rate of pressure change can be estimated to be roughly given by:

$$\alpha\beta\frac{dT_{avg}}{dt}$$

where $\alpha$ is the isobaric coefficient of thermal expansion of the fluid and $\beta$ is the bulk modulus, and $$\frac{dT_{avg}}{dt}$$

represents the rate of change of average fluid temperature.

Figure 5:
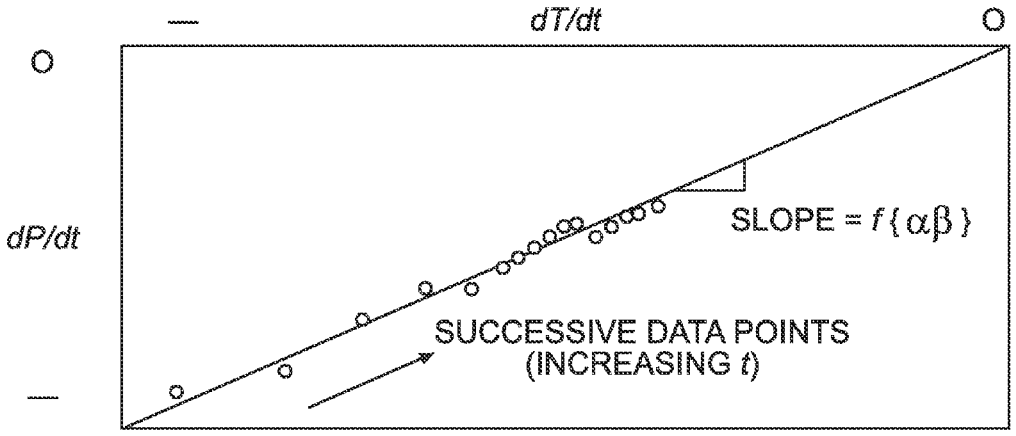
FIG. 5 is an example plot showing the relationship of measured data and a best fit line of the change in pressure over time (dP/dt) with respect to the change in temperature over time (dT/dt) in accordance with aspects of the present disclosure.

FIG. 5 depicts the expected correlation of pressure change versus temperature change. The expected slope would be determined from previous representative tests deemed to have been non-leaking. Successive data points forming a trend similar to the expected slope would be interpreted as indicative of non-leaking pressure behavior. Successive data points forming a trend less than the expected slope would be interpreted as a possible leak indicator. Successive data points forming a trend greater than the expected slope would be interpreted as a possible indicator of external non-representative pressurization sources.

As such, when the computer 122, executing the testing tool 124, measures the changes in pressure and temperature, the computer 122 can plot the changes in pressure versus the changes in temperature over time and determine the slope in order to identify a leak in the portion 402.

In 335, the process can end, return to any point or repeat.

While not described above, the computer 122, executing the testing tool 124, can perform other processes on the data gathered during the pressure integrity testing, e.g. the data representing the changes in pressure and temperature. For example, the computer 122 can store a copy of the data gathered during the pressure integrity testing in a computer readable storage medium associated with the computer 122. For instance, the computer 122 can store a copy of the data gathered during the pressure integrity testing in the main memory 206, the secondary memory 208, and/or other remote computer readable storage media that can be connected to the computer 122 via the network 218. Likewise, the computer 122, executing the testing tool 124, can perform other types of analysis on the changes in pressure and temperature for the portion 402 to determine whether the portion 402 is leaking. For example, the computer 122, executing the testing tool 124, can perform analysis described in U.S. Pat. No. 7,706,980 to Winters et al., the entirety of which is incorporated herein by reference.

Figure 6A:
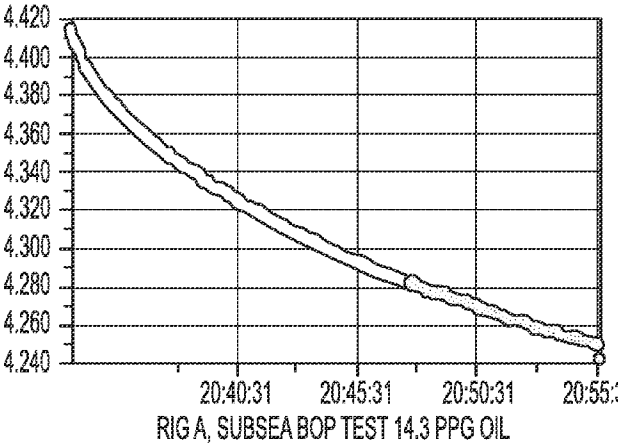
FIGS. 6A-6D show example pressure data obtained for subsea BOP test in accordance with aspects of the present disclosure.
Figure 6B:
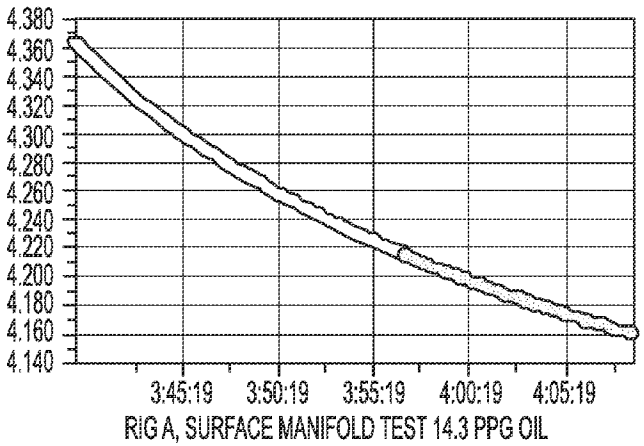
Figure 6C:
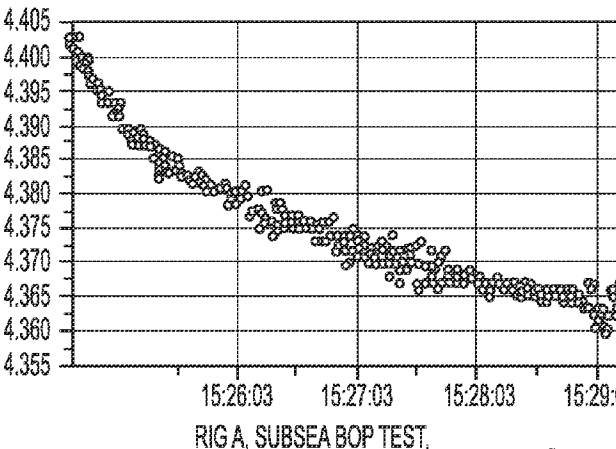
Figure 6D:
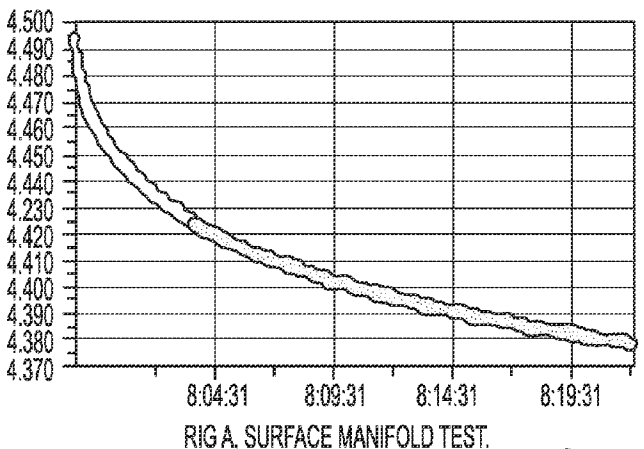
Figure 7:
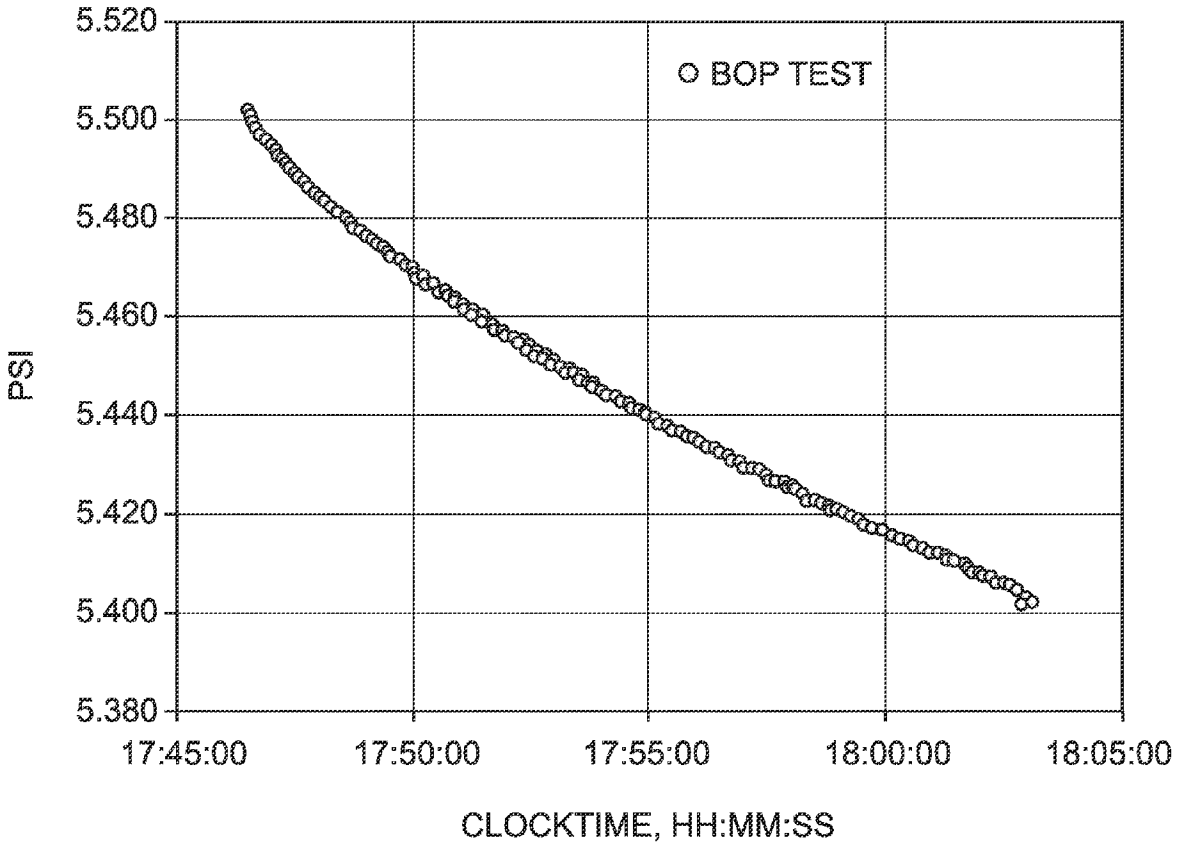
FIG. 7 shows a plot of declining pressure behavior in accordance with aspects of the present disclosure.

For example, often with use of water based fluids (seawater and completion brines) there appears to be 'noise' superimposed on the pressure data of subsea BOP tests. This is evident in the lower left graph illustrated in FIG. 6D. This somewhat obscures the view of the pressure trend where it is desired to discern small representative changes in pressure. Such noise is not apparent with use of oil based fluids (synthetic base mud) in subsea BOP tests, nor is it apparent with use of water or oil based fluids in surface manifold tests. It appears that the noise occurs in the choke or kill lines, and its effects can be isolated from the BOP test cavity with the test setups configured according to the process described above and below.

Nearly every rig uses seawater to conduct subsea BOP pressure tests immediately upon lowering and latching the marine drilling riser and its 'lower marine riser package' (LMRP) to the BOP stack. Some rigs devote the majority of their time to well completion operations during which seawater and completion brines are predominantly used in pressure tests. Implementations can be expected to reduce or eliminate 'noisy' pressure data during such tests conducted with water based fluids.

It is possible to pressurize subsea BOP tests via the drill string and in conjunction with a specialized 'BOP test tool'. U.S. Pat. No. 6,044,690 (Shearable Multi-Gage Blowout Preventer Test Tool and Method, Apr. 4, 2000) describes one such test tool. There is a related practice for the drill string to be the pressure path to surface while monitoring BOP test pressures. In such cases the same type of declining pressure behavior shown in FIG. 7 and FIGS. 6A-6D results.

According to implementations, to prevent the declining pressure behavior that occurs in substantial conduit lengths (choke lines, kill lines, drill pipe) from being superimposed on the pressure within a subsea pressure-tested cavity, the above process can be made applicable to cases of pressurization via drill string, but only if a majority of the drill string fluid volume can be isolated from the downhole pressure-tested cavity once the cavity is pressurized. Certain BOP test tools might be modified through addition of a sealing mechanism that permits pressurization from surface when opened yet blocks the pressure path to surface when closed. A suitable check-valve arrangement might provide such a sealing mechanism.

Likewise, the computer 122 can provide the data gathered during pressure integrity testing to other computer systems connected to the computer 122 via the network 218. Additionally, the computer 122 can display the data gathered during the integrity testing in a graphical form on a display associated with the computer 122.

Figure 8:
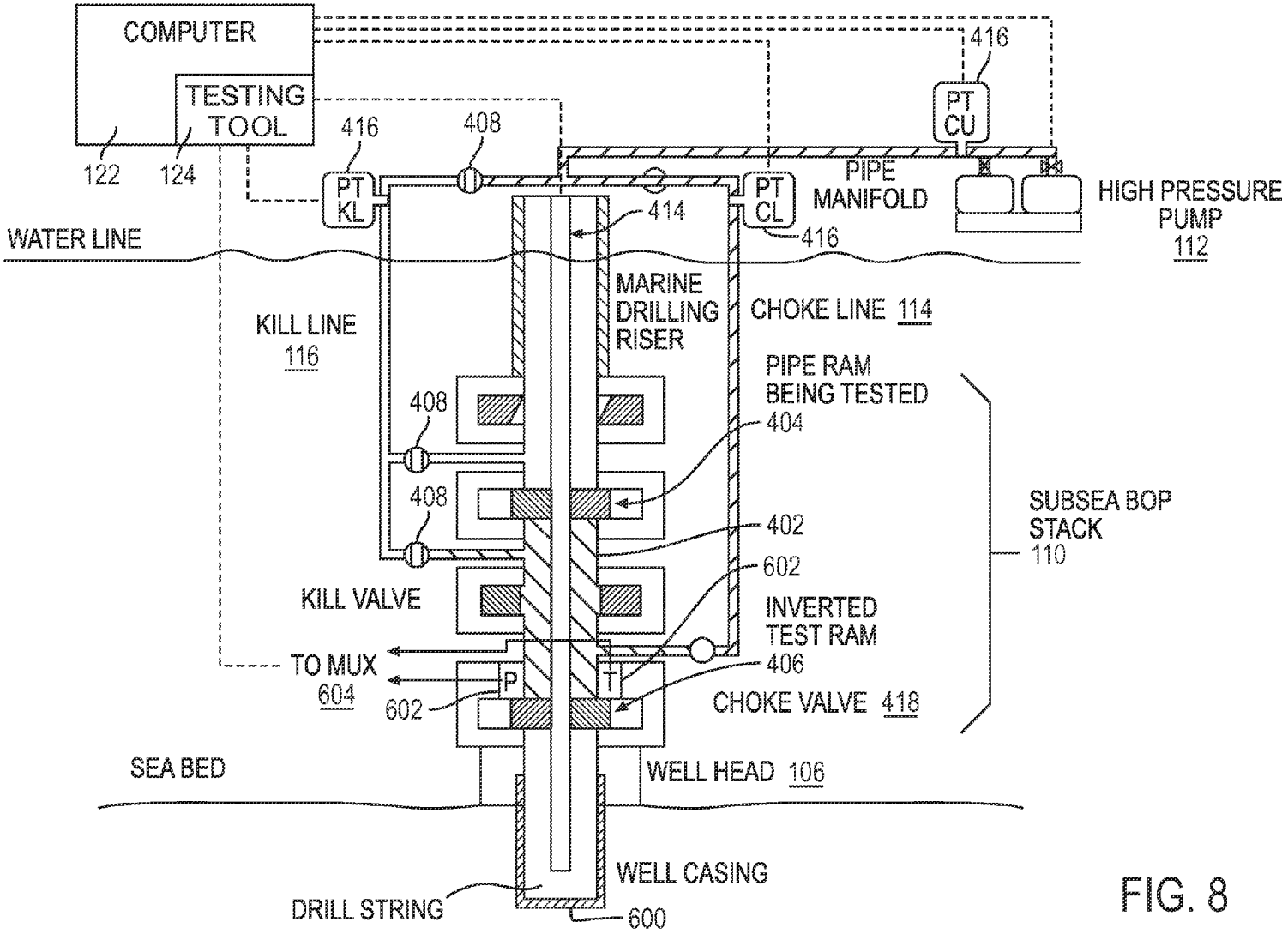
FIG. 8 is another generalized schematic diagram that illustrates examples of a testing process, according to aspects of the disclosure.

As described above, the process 300 can be utilized with the drill string 410 that include the sensor subs 412. According to implementations, the process 300 can be performed utilizing other pressure and temperature sensors positioned in the well system 100. FIG. 8 illustrates another example of pressure and temperature sensors that can be utilized with process 300.

As illustrated in FIG. 8, the BOP stack 110 can be fitted with, or can be provisioned for, pressure and temperature sensors 602 that transmit data to the computer 124 via electrical cabling (or wireless devices and signals) provided within the MUX umbilical connection 604 between surface and the subsea BOP control system. In implementations, the pressure and temperature sensors 602 can be positioned nearest the inverted test ram 406 so that they are within the various pressurized volumes of the portion 402. As such, the pressure and temperature sensors 602 can be utilized to perform the process 300 or any other pressure integrity test described herein.

As illustrated in FIG. 8, the pressure and temperature sensors 602 can be positioned nearest the inverted test ram 406 so that they are within the various pressurized volumes of the portion 402. Likewise, the pressure and temperature sensor 602 can be positioned at any location in close proximity to the BOP stack. For example, the pressure and temperature sensors 602 depicted in can be tapped into the choke line 114 or kill line 116 near the BOP stack 110 and their outputs transmitted to surface via MUX line.

Figure 9:
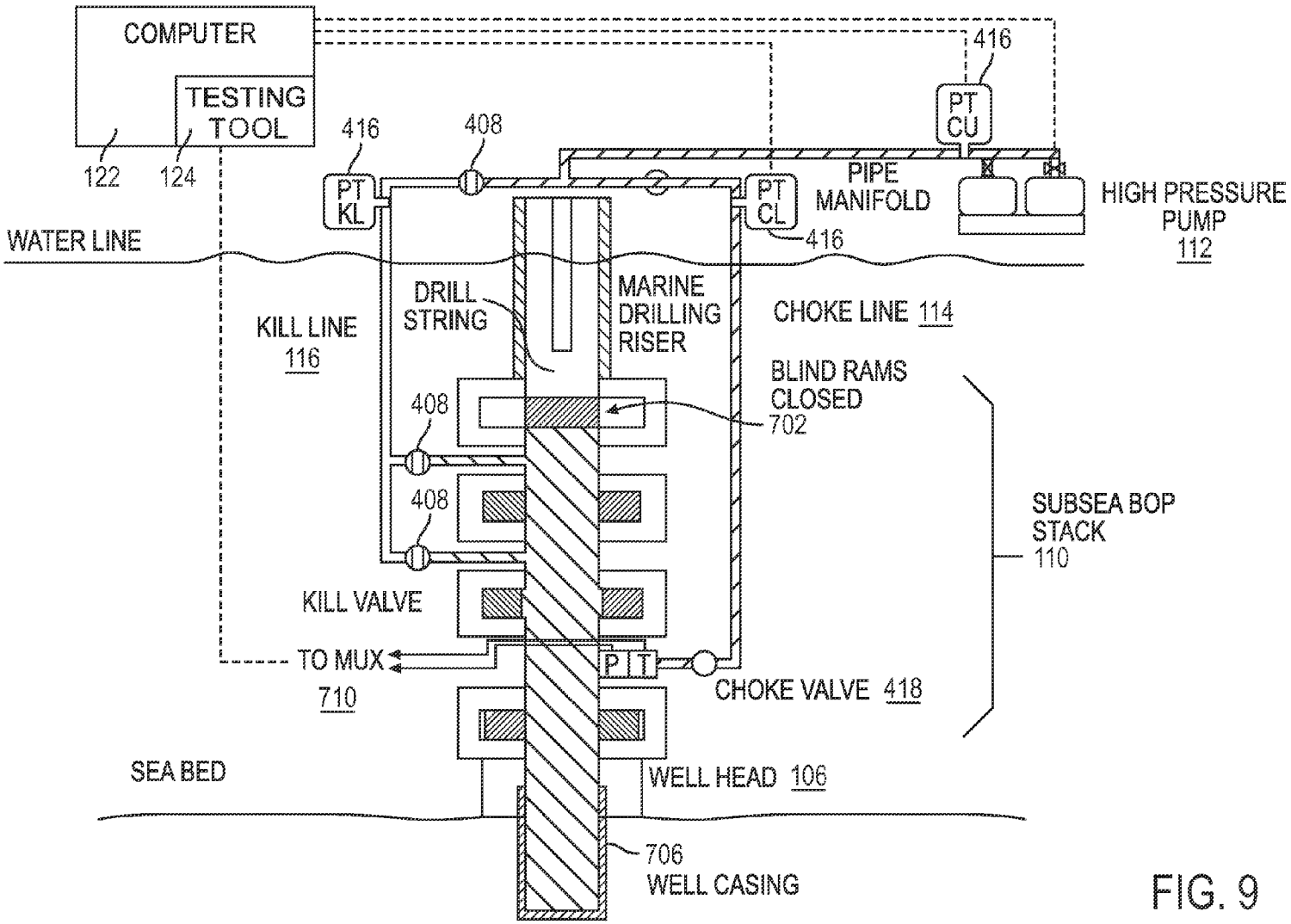
FIG. 9 is still another generalized schematic diagram that illustrates examples of a testing process, according to aspects of the disclosure.

As described above, the process 300 can be utilized to pressure integrity test the wellhead 106 of the well system 100. Likewise, the process 300 can be utilized to pressure integrity test any other components of the well system 100. FIG. 9 illustrates another example of the well system 100 in which the casing and liner can be pressure integrity tested using process 300.

As illustrated in FIG. 9, a blind ram 702 can be closed to isolate a portion 704 of the well system 100. The portion 704 can include the well head 106 and the well casing (and liner) 706. The computer 122 can communicate with pressure and temperature sensors 708 via the MUX connection 710 to perform the process 300. As illustrated, the pressure and temperature sensors 708 can be located in choke line 114 in proximity to the BOP stack 110. One skilled in the art will realize that any of the above configurations and process can also be utilized to test the well casings and liners.

Figure 10:
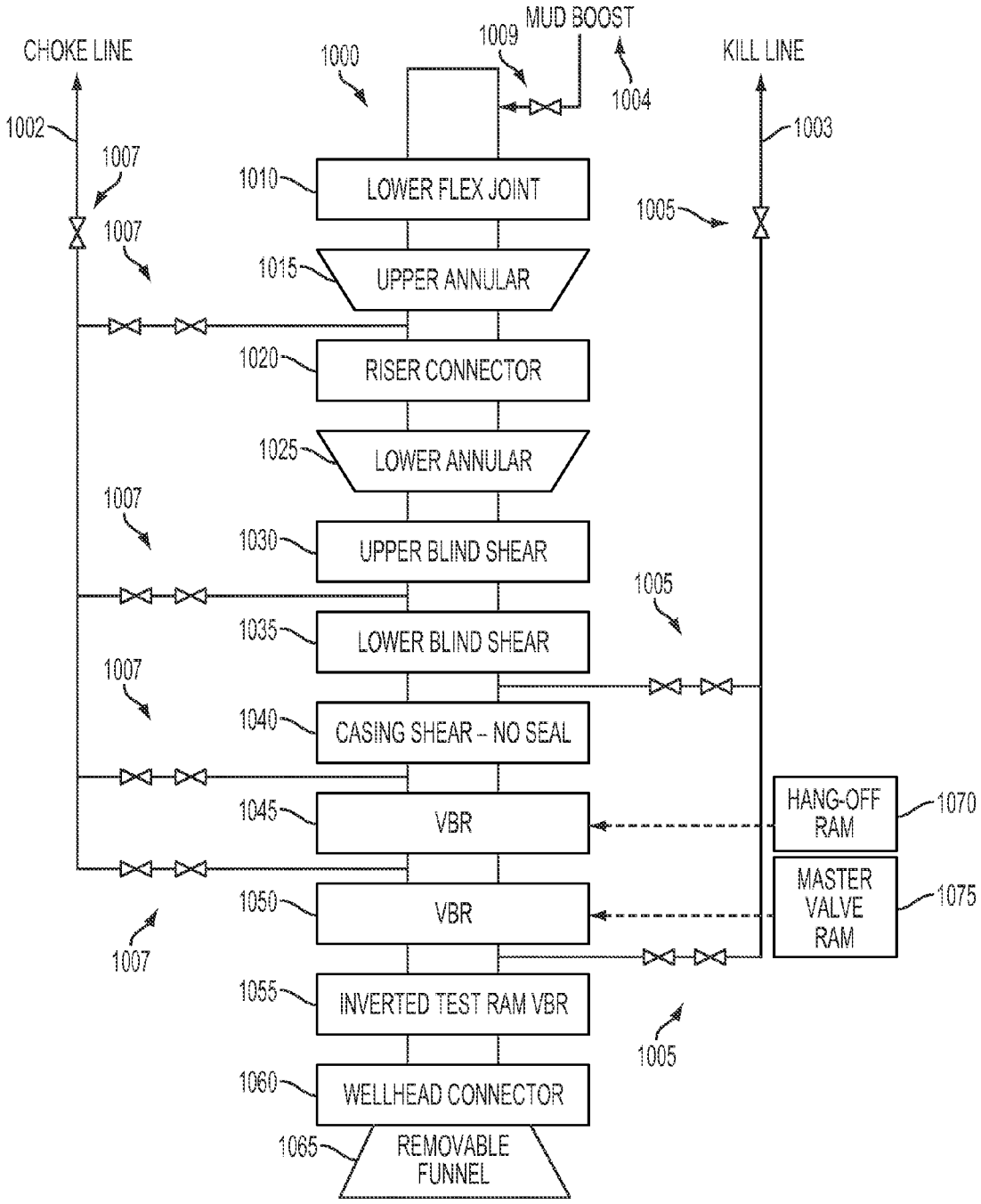
FIGS. 10 and 11 are generalized schematic diagrams that illustrate examples of blowout preventer stacks, according to aspects of the disclosure.
Figure 11:
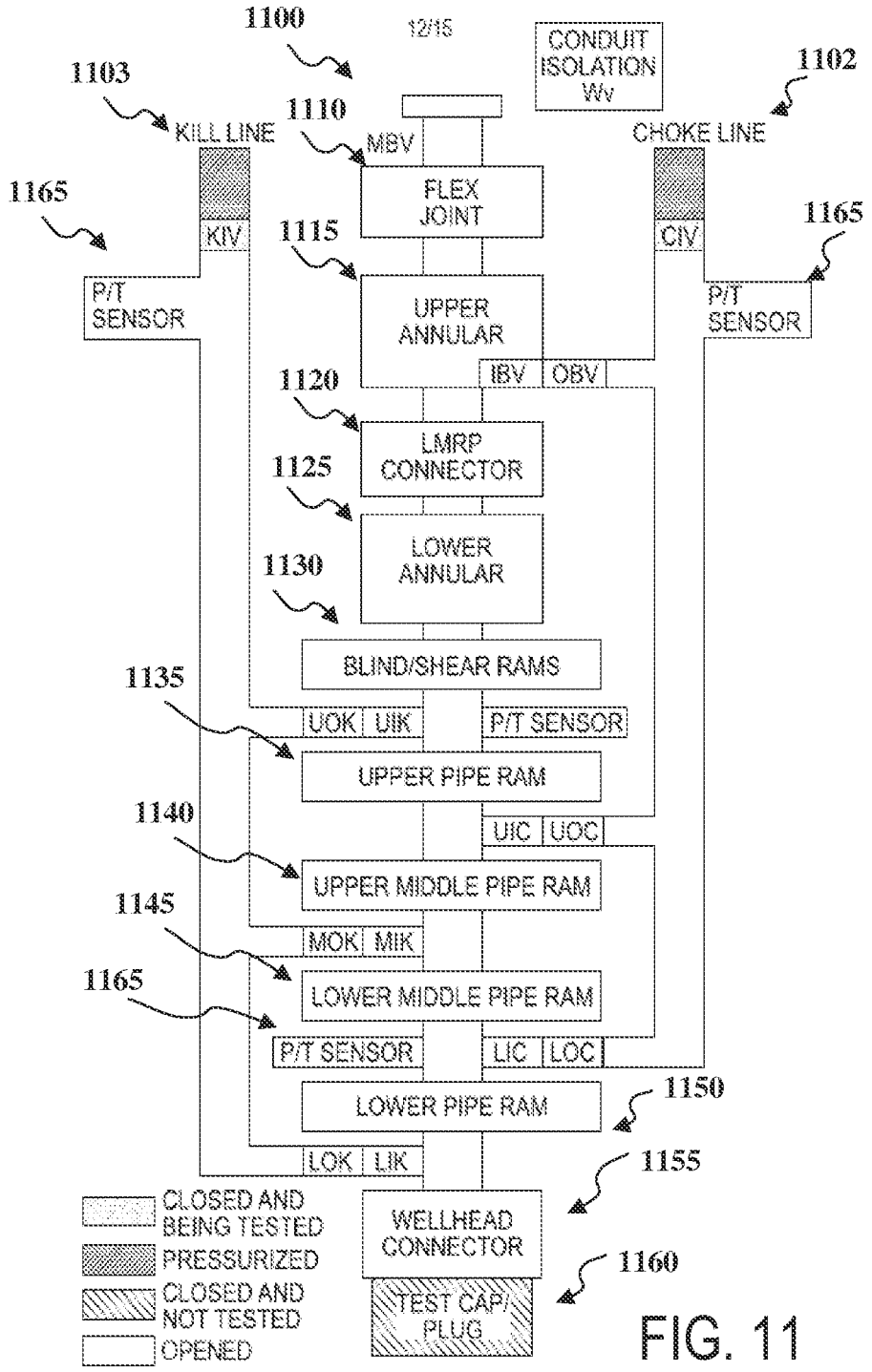

As mentioned above, the well system 100 including the BOP stack 110 can be configured in a variety of configuration and include various components. FIGS. 10 and 11 illustrate various other examples of configuration of the BOP stack 110 and the location of pressure and temperature sensors, according to implementations. In implementations, the processes of determining pressure integrity an be utilized on the example of the BOP stack illustrated in FIGS. 10 and 11.

In FIG. 10, an example BOP stack 1000 configuration is shown comprising several individual blowout preventers assemble together. In normal drilling operations, the primary well control is achieved by hydrostatic pressure: the weight of the drilling mud counterbalances pressure from the reservoir and prevents hydrocarbons from flowing into the wellbore. The BOP stack 1000 serves as a secondary means of well control, such that when a formation influx occurs during drilling, one or more BOPs 1015, 1025, 1030, 1035, 1040, 1045, 1050, 1055, and 1060 are activated to seal the annulus or wellbore. Denser or heavier mud is then pumped through the choke line 1002, having valves 1007, kill line 1003, having valves 1005, and/or mud boost line 1004, having valve 1009, until the downhole pressure is controlled and the influx is circulated out of the well. Once this "kill weight" mud extends from the bottom of the well to the top, the well is back in balance and has been "killed."

The one or more BOPs 1015, 1025, 1030, 1035, 1040, 1045, 1050, 1055, and 1060 can include one or more ram BOP, which is a value that uses a pair of opposing pistons and steel ram blocks that are operable to close to halt returning flow or remain open to permit flow. The inner and top faces of the ram blocks are fitted with elastomeric seals or packers that seal against the ram blocks, between each other, against the drill pipe running through the wellbore, against the ram cavity, and against the wellbore. Outlets at the sides of the BOP body are used for connection to choke 1007 and kill valves 1005 and piping 1002 and 1003, respectively. The ram BOP can come in three types of rams, or ram blocks, including variable bore pipe rams (VBRs), blind shear rams (BSRs), and casing shear rams (CSRs).

VBRs can close around a range of tubing and drill pipe outside diameters. For example, VBRs can close around a pipe with a diameter ranging from 3½ in. to 6⅝ in. VBRs can be converted to test rams. Test rams are VBRs inverted to seal pressure from above. Test rams reduce the time required to prepare for BOP pressure testing, as well as the time required to resume drilling operations afterward. By closing the test ram, the VBRs, annulars, and stack valves above can be pressure tested against the drill string and the annulus without exposing the well below the BOP to test pressure.

BSRs (also known as shearing blind rams or sealing shear rams) are designed to seal a wellbore, even when the bore is occupied by the drill pipe, by cutting through the drill pipe as the rams close off and seal the well. CSRs (also known as super shear rams) cut through heavy wall or large diameter pipe with hardened steel blades but are not designed to seal the well. They typically are used for shearing the heaviest drill pipe and casing.

The one or more BOPs 1015, 1025, 1030, 1035, 1040, 1045, 1050, 1055, and 1060 on the BOP stack 1000 can be arranged in a variety of configurations depending on the requirements of the well operator. FIG. 10 shows one example arrangement including a lower flex joint 1010, a upper annular 1015, a riser connector 1020 for the lower marine riser package (LMRP), a lower annular 1025, a upper blind shear ram 1030, a lower blind shear ram 1035, a casing shear (no seal) 1040, two VBRs 1045 and 1050, an inverted test ram VBR 1055, a wellhead connector 1060, and a removable funnel 1065. A Hang-off ram 1070 can be coupled to the VBR 1045 and a master valve ram can be coupled to the VBR 1050. The wellhead connector 1060 can be attached at the bottom of the BOP stack 1000 and can be used to lock the BOP stack 1000 onto the wellhead. A metal gasket (not shown) can be used to ensure pressure integrity between the wellhead connector 1060 and the wellhead. Because the well head connector 1060 is typically hydraulically actuated, the BOP stack 1000 can be remotely attached or released from the wellhead. The ram and annular BOPs do not close instantaneously to seal the wellbore. They are activated by hydraulic fluid moving pistons and, therefore, take seconds to move from the open to closed position. Additional or fewer components can be added to the BOP stack depending on the requirements of the operator.

In FIG. 11, an example BOP stack 1100 configuration is shown including a flex joint 1110, a upper annular 1115, a riser connector 1120 for the lower marine riser package (LMRP), a lower annular 1125, blind/shear rams 1030, an upper pipe ram 1135, an upper middle pipe ram 1140, a lower middle pipe ram 1145, a lower pipe ram 1150, a wellhead connector 1055, and a test cap/plug 1060. Pressure/temperature sensors 1165 can be arranged relative to the choke line 1102, the kill line 1103, and, for example, between the lower middle pipe ram 1145 and the lower pipe ram 1150.

In any of the examples described above, the test pressures utilized and the period of time for monitoring the pressure can depend on the well system or BOP component under test. For example, when testing BOP components, a low-pressure test and a high-pressure test can be performed. For the low-pressure test, the choke line 114 (1002, 1102), the kill line 116 (1003, 1103), and the BOP component can be pressurized to a test pressure in a range of approximately 200 psi to approximately 300 psi. For the high-pressure test, the test pressure can depend on the particular component of the BOP under test. For example, for ram-type BOPs, choke manifolds, and other BOP components, the high pressure test can be approximate equal to the rated working pressure of the equipment or approximately equal to the maximum anticipated pressure in the well interval. Likewise, for example, for annular-type BOPs, the high pressure test can be approximately equal to 70 percent of the rated working pressure of the equipment. For instance, annular BOPs can have a rated working pressure of approximately 5,000 psi, approximately 7,500 psi, or approximately 10,000 psi.

Additionally, when testing casing and/or liners, different test pressures can be utilized, for example, between approximately 200 psi to approximately 7,500 psi. For example, when testing drive or structural casing types, the choke line 114, the kill line 116, and the casing can be pressurized to any minimum test pressure. Likewise, for example, when testing conductor casing types, the choke line 114, the kill line 116, and the casing can be pressurized to a minimum test pressure of approximately 200 psi. Likewise, for example, when testing surface, intermediate, and production casing types, the choke line 114, the kill line 116, and the casing can be pressurized to a minimum test pressure of approximately 70 percent of the casing's minimum internal yield.

Additionally, for example, when testing drilling liner and liner-lap, the choke line 114, the kill line 116, and the liner can be pressurized to a test pressure approximately equal to the anticipated pressure which the liner will be subjected during the formation pressure-integrity test below that liner shoe or subsequent liner shoe. Likewise, for example, when testing production liner and liner-lap, the choke line 114, the kill line 116, and the liner can be pressurized to a minimum test pressure of approximately 500 psi above the formation fracture pressure at the casing shoe into which the liner is lapped. In any of the above examples, the operator of the computer 122 can set the test pressure to any desired test pressure. Likewise, the testing tool 124 can automatically set the test pressure to any test pressure.

In any of the above examples, the period of time for which the change in pressure is measured can be any adequate time period to determine if the change in pressure reaches a steady state and/or any adequate time period to extrapolate whether the change in pressure will reach a steady state. For example, the period of time can range from approximately 10 minutes to approximately 90 minutes.

In addition to BOP tests, casing tests and casing/liner tests already discussed, process 300 be considered utilized with other types of positive pressure tests conducted in well systems. These include but are not limited to casing hanger seal assembly tests, formation integrity tests, leak isolation diagnostic tests and abandonment plug tests.

In process described above, pressure can be released at end of a test by opening a CU valve and bleeding back fluid to surface. This can be included with process 300 and can include opening a subsea choke or kill valve in advance of opening a CU valve. It is expected that at end of subsea BOP or casing/liner tests conducted per process 300 there will be a pressure differential across the subsea valve potentially of several hundred psi. The pressure difference will be the amount of pressure decline that occurs in the choke or kill line minus that which occurs in the test cavity during the shut-in test period. Both will be measured during the test period so the pressure difference can be reliably estimated. If desired to minimize potential 'hammer' effects or valve wear that may occur upon opening a subsea valve in presence of a pressure differential, the CU pump can be used to raise choke or kill line pressure, or pressure can be bled-down at the CU, such that pressure differential across the subsea valve is minimized before opening.

Figure 12:
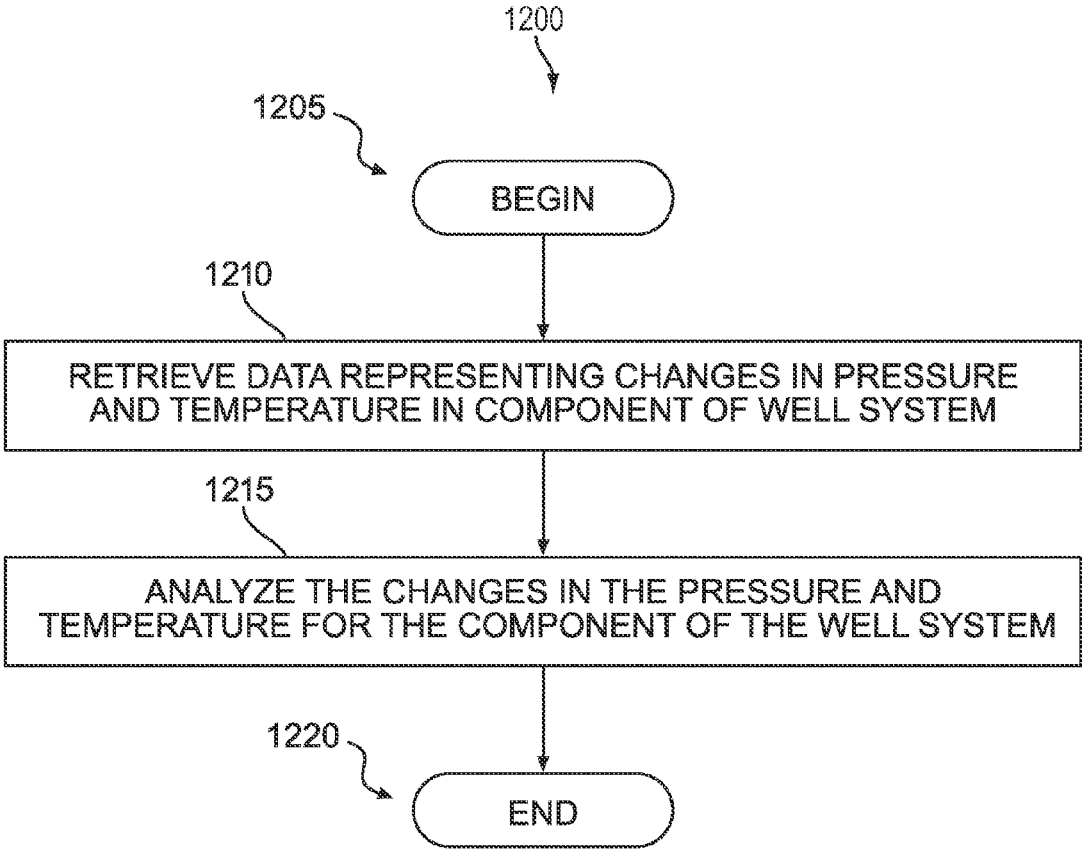
FIG. 12 is a flowchart that illustrates another exemplary process for testing the pressure integrity of components of a well system, according to aspects of the present disclosure.

In the process 300 as described above, the computer 122, executing the testing tool 124, can perform analysis as the data, representing the changes in pressure and temperature, is received from the sensors in the well system 100. Likewise, the computer 122 can capture the data, representing the change in pressure, and store the data for later subtraction and analysis. FIG. 12 is a flow diagram that illustrates another exemplary process 1200 for testing components of the well system 100. One skilled in the art will realize that the exemplary process can be performed on any component of the well system 100, for example.

In 1205, the process can begin. In 1210, the computer 122, executing the testing tool 124, can retrieve data representing the changes in pressure and temperature. For example, the computer readable storage medium can be the main memory 206, the secondary memory 208, and/or other remote computer readable storage media that can be connected to the computer 122 via the network 218.

In 1215, the computer 122, executing the testing tool 124, can analyze the changes in pressure and temperature for the component of the well system 100 as described above. In 1220, the process can end, return to any point or repeat.

Figure 13:
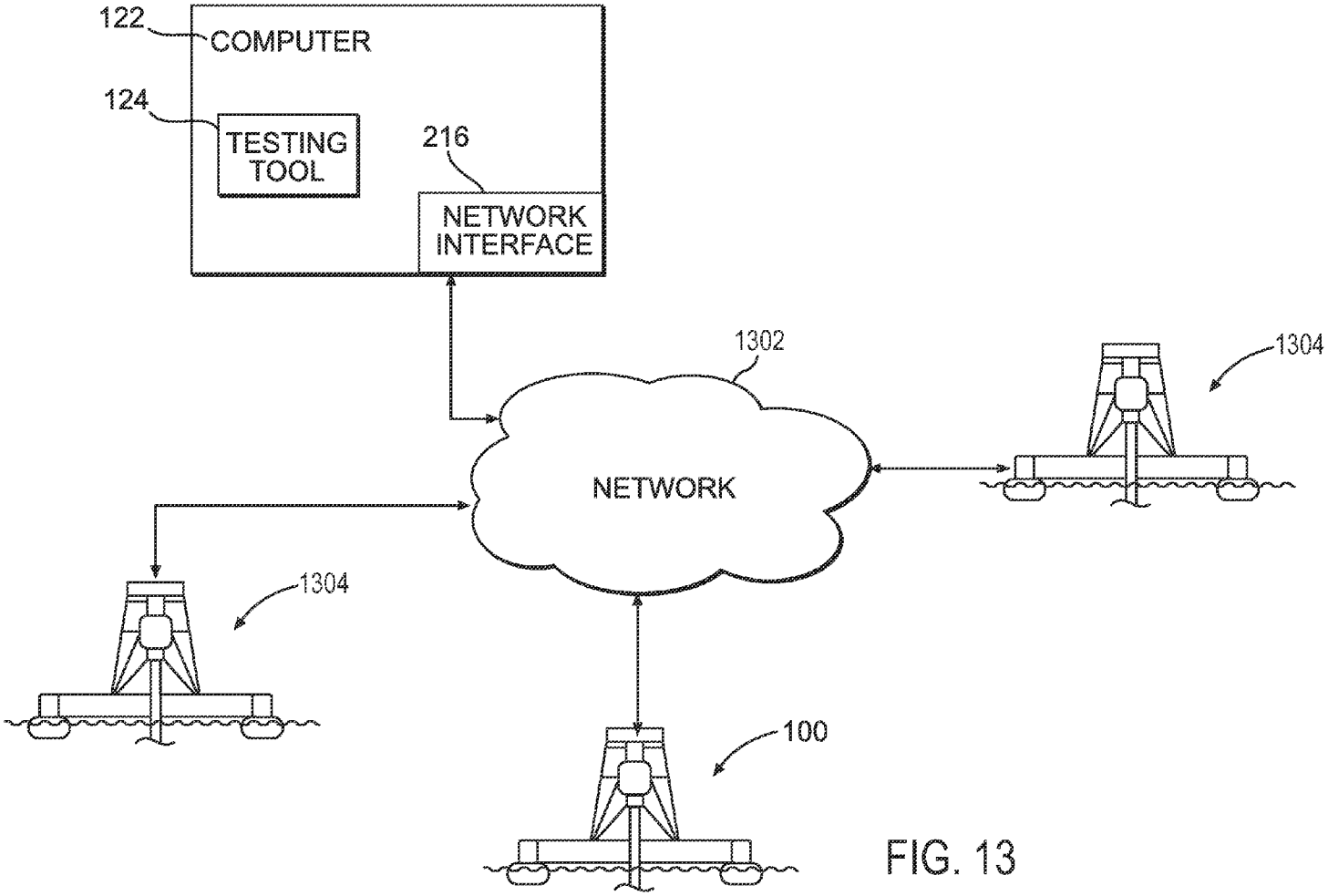
FIG. 13 is a generalized schematic diagram that illustrates another configuration of the computer system that includes the testing tool, according to aspects of the present disclosure FIG. 14 a flowchart that illustrates another exemplary process for testing the pressure integrity of components of a well system, according to aspects of the present disclosure.

In FIG. 1 described above, the computer 122 can be located at the well system 100. FIG. 13 is a generalized schematic diagram that illustrates another configuration of the computer system that includes the testing tool. While FIG. 13 illustrates various components associated with the computer 122, one skilled in the art will realize that FIG. 13 is exemplary and that additional components can be added and existing components can be removed.

As illustrated in FIG. 13, the computer 122 can be remotely located from the well system 100. The computer 122 can communicate with the well system 100, computers located at the well system 100, and the components of the well system 100 via a network 1302. The network 1302 can be any type of local-area network, wide-area network, and/or public network, such as the Internet. The computer 122 can utilize the network interface 216 to communicate with the well system 100, computers located at the well system 100, and the components of the well system 100 via a network 1302 to perform the processes described above. Additionally, as illustrated, the computer 122 can be coupled to one or more geographically diverse well systems 1304 via the network 1302. As such, the computer 122, executing the testing tool 124, can perform the processes described above on any of the one or more additional well systems 1304.

Figure 14:
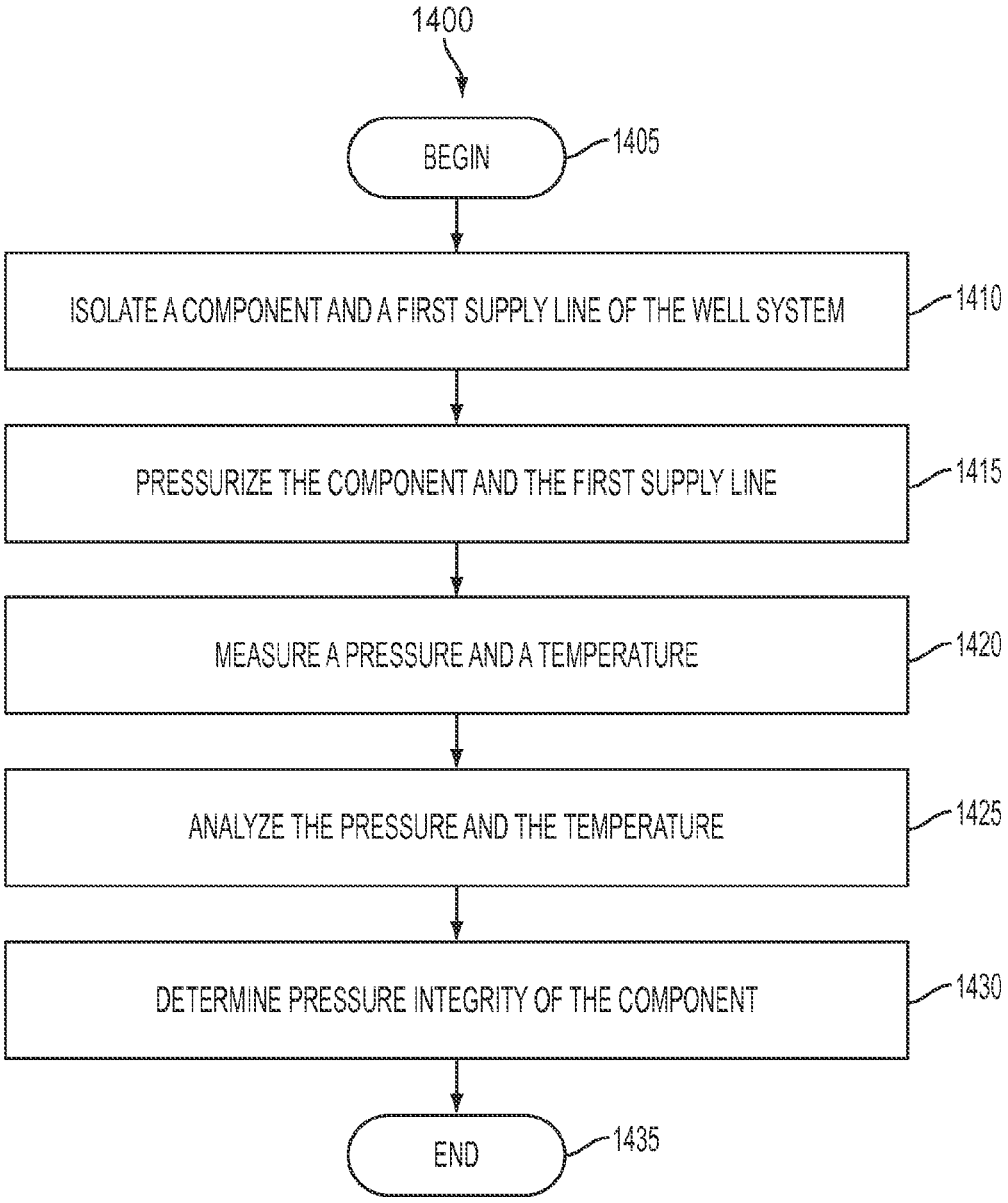

As described above, in one example, the kill line can be isolated from a component of the hydrocarbon well system and the chock line. In implementations, any supply line can be utilized in testing the hydrocarbon well system. FIG. 14 is a flow diagram illustrates a generalized process 1400 for testing components of a hydrocarbon well system.

The method begins at 1405, and at 1410 a component of the hydrocarbon well system and a first supply line to the component can be isolated from other components of the hydrocarbon well system. For example, the component and the first supply line can be isolated by closing one or more valves in the hydrocarbon well system and closing one or more sealing structures above and below the component. Depending on what is being tested, the first supply line can be the choke line 114 or the kill line 116. With reference to FIG. 4B, the kill line 116 can isolated from the choke line 114 and the compartment 402 by closing one or more valves 408 and sealing the pipe ram 404 and the inverted test ram 406. Alternatively, choke line 114 can be isolated from kill line 116 by closing one or more choke valves.

In 1415, the component and the first supply line can be pressurized to a test pressure with a test fluid. With reference to FIG. 4B, high pressure pump 112 can be activated by the computer 122 to pressure the component and the first supply line.

In 1420, a pressure and a temperature of the test fluid in the component can be measured that was pressurized over a period of time. For example one or more sensors can be controlled by the computer 122 and can be arranged at one or more locations along the wellbore, including along the tool string inside the wellbore or proximate to the casing in the wellbore. The one or more sensors can be operable to measure pressure, temperature, or both for a period of time.

In 1425, the pressure and the temperature that were measured can be analyzed by the computer 122. For example, computer 122 can include one or more applications that can be used to perform various statistical analyses of the measured data. The one or more programs can be operable to determine relationships, if any, between a change in pressure over time (dP/dt) with respect to a change in temperature over time (dT/dt). For example, linear relationships between (dP/dt) and (dT/dt) can be determined and best fit lines can be produced to characterize the relationships.

In 1430, the pressure integrity of the component being tested can be determined. For example, the one or more programs can compare newly acquired data with the best fit line to characterize the pressure integrity of the component being tested. The process can end at 1435, or return to any point in the process.

Certain implementations can be performed as a software program. The software program can exist in a variety of forms both active and inactive. For example, the software program can exist as software program(s) comprised of program instructions in source code, object code, executable code or other formats; firmware program(s); or hardware description language (HDL) files. Any of the above can be embodied on a computer readable medium, which include non-transitory computer readable storage devices and media, and signals, in compressed or uncompressed form. Exemplary non-transitory computer readable storage devices and media include conventional computer system RAM (random access memory), ROM (read-only memory), EPROM (erasable, programmable ROM), EEPROM (electrically erasable, programmable ROM), and magnetic or optical disks or tapes. Exemplary computer readable signals, whether modulated using a carrier or not, are signals that a computer system hosting or running the present teachings can be configured to access, including signals downloaded through the Internet or other networks. Concrete examples of the foregoing include distribution of executable software program(s) on a CD-ROM or via Internet download. In a sense, the Internet itself, as an abstract entity, is a computer readable medium. The same is true of computer networks in general.

While the teachings have been described with reference to examples of the implementations thereof, those skilled in the art will be able to make various modifications to the described implementations without departing from the true spirit and scope. The terms and descriptions used herein are set forth by way of illustration only and are not meant as limitations. In particular, although the method has been described by examples, the steps of the method may be performed in a different order than illustrated or simultaneously. Furthermore, to the extent that the terms "including", "includes", "having", "has", "with", or variants thereof are used in either the detailed description and the claims, such terms are intended to be inclusive in a manner similar to the term "comprising." As used herein, the terms "one or more of" and "at least one of" with respect to a listing of items such as, for example, A and B, means A alone, B alone, or A and B. Further, unless specified otherwise, the term "set" should be interpreted as "one or more." Also, the term "couple" or "couples" is intended to mean either an indirect or direct connection. Thus, if a first device couples to a second device, that connection may be through a direct connection, or through an indirect connection via other devices, components, and connections.

What is claimed is:

1. A computer-implemented method for testing components of a hydrocarbon well system, comprising:

isolating a component of the hydrocarbon well system and a supply line to the component from other components of the hydrocarbon well system;

pressurizing the component and the supply line to a test pressure with a test fluid;

measuring, over a period of time, a pressure and a temperature of the test fluid in the component that was pressurized;

analyzing, by a processor, the pressure and the temperature that were measured for changes or absence of changes in the pressure, the temperature, or both the pressure and the temperature correlated to the state of the component's pressure integrity; and determining a pressure integrity of the component based on the analysis.

2. The computer-implemented method of claim 1, the method further comprising:

testing a pressure integrity of the supply line prior to pressurizing the supply line.

3. The computer-implemented method of claim 1, wherein the component of the hydrocarbon well system comprises at least one of a well head and a portion of a blowout preventer.

4. The computer-implemented method of claim 1, wherein the supply line comprises a kill line or a choke line.

5. The computer-implemented method of claim 1, wherein analyzing the pressure and the temperature comprises:

determining that the pressure and the temperature has reached a steady state.

6. The computer-implementing method of claim 1, wherein isolating the component and the supply line comprises:

closing one or more valves in the hydrocarbon well system.

7. The computer-implementing method of claim 1, wherein isolating the component and the supply line comprises:

closing one or more sealing structures above and below the component.

8. The computer-implemented method of claim 1, wherein analyzing the pressure and the temperature that were measured comprises:

determining a change in pressure over the period of time;

determining a change in temperature over the period of time; and plotting the change in pressure over the period of time against the change in temperature over the period of time.

9. The computer-implemented method of claim 8, wherein plotting the change in pressure over the period of time against the change in temperature over the period of time further comprises:

determining a linear best fit line using a linear regression algorithm.

10. The computer-implemented method of claim 9, the method further comprising:

measuring the pressure and temperature at a second time and comparing the pressure and temperature measured at the second time with the linear best fit line.

11. The computer-implemented method of claim 10, wherein comparing the pressure and temperature measured at the second time with the linear best fit line further comprises:

determining that the pressure integrity of the component has been compromised if the pressure and temperature measured at the second time is below the linear best fit line.

12. The computer-implemented method of claim 10, wherein comparing the pressure and temperature measured at the second time with the linear best fit line further comprises:

determining that the pressure integrity of the component has not been compromised if the pressure and temperature measured at the second time is along or near the linear best fit line.

13. The computer-implemented method of claim 10, wherein comparing the pressure and temperature measured at the second time with the linear best fit line further comprises:

determining a presence of an external non-representative pressurization source if the pressure and temperature measured at the second time is above the linear best fit line.

14. The computer-implemented method of claim 1, wherein analyzing the pressure and the temperature that were measured comprises:

comparing the pressure and the temperature that were measured with historic pressure and temperature data that were obtained for the hydrocarbon well system.

15. A device comprising:

one or more processors; and a non-transitory computer readable storage medium comprising instructions that cause the one or more processors to perform a method testing components of a hydrocarbon well system, the method comprising:

isolating a component of the hydrocarbon well system and a supply line to the component from other components of the hydrocarbon well system;

pressurizing the component and the supply line to a test pressure with a test fluid;

measuring, over a period of time, a pressure and a temperature of the test fluid in the component that was pressurized;

analyzing the pressure and the temperature that were measured for changes or absence of changes in the pressure, the temperature, or both the pressure and the temperature correlated to the state of the component's pressure integrity; and determining a pressure integrity of the component based on the analysis.

16. The device of claim 15, wherein the instructions cause the one or more processors to perform the method further comprising:

testing a pressure integrity of the supply line prior to pressurizing the supply line.

17. The device of claim 15, wherein the component of the hydrocarbon well system comprises at least one of a well head and a portion of a blowout preventer.

18. The device of claim 15, wherein the supply line comprises a kill line or a choke line.

19. The device of claim 15, wherein analyzing the pressure and the temperature comprises:

determining that the pressure and the temperature has reached a steady state.

20. The device of claim 15, wherein isolating the component and the supply line comprises:

closing one or more valves in the hydrocarbon well system.

21. The device of claim 15, wherein the isolating the component and the supply line comprises:

closing one or more sealing structures above and below the component.

22. The device of claim 15, wherein analyzing the pressure and the temperature that were measured comprises:

determining a change in pressure over the period of time;

determining a change in temperature over the period of time; and plotting the change in pressure over the period of time against the change in temperature over the period of time.

23. The device of claim 22, wherein plotting the change in pressure over the period of time against the change in temperature over the period of time further comprises:

determining a linear best fit line using a linear regression algorithm.

24. The device of claim 23, wherein the instructions cause the one or more processors to perform the method further comprising:

measuring the pressure and temperature at a second time; and comparing the pressure and temperature measured at the second time with the linear best fit line.

25. The device of claim 24, wherein comparing the pressure and temperature measured at the second time with the linear best fit line further comprises:

determining that the pressure integrity of the component has been compromised if the pressure and temperature measured at the second time is below the linear best fit line.

26. The device of claim 24, wherein comparing the pressure and temperature measured at the second time with the linear best fit line further comprises:

determining that the pressure integrity of the component has not been compromised if the pressure and temperature measured at the second time is along or near the linear best fit line.

27. The device of claim 24, wherein the comparing the pressure and temperature measured at the second time with the linear best fit line further comprises:

determining a presence of an external non-representative pressurization source if the pressure and temperature measured at the second time is above the linear best fit line.

28. A non-transitory computer readable storage medium comprising instructions that cause one or more processors to perform a method testing components of a hydrocarbon well system, the method comprising:

isolating a component of the hydrocarbon well system and a supply line to the component from other components of the hydrocarbon well system;

pressurizing the component and the supply line to a test pressure with a test fluid;

measuring, over a period of time, a pressure and a temperature of the test fluid in the component that was pressurized;

analyzing the pressure and the temperature that were measured for changes or absence of changes in the pressure, the temperature, or both the pressure and the temperature correlated to the state of the component's pressure integrity; and determining a pressure integrity of the component based on the analysis.

29. The non-transitory computer readable storage medium of claim 28, wherein analyzing the pressure and the temperature that were measured comprises: determining a change in pressure over the period of time;

determining a change in temperature over the period of time; and plotting the change in pressure over the period of time against the change in temperature over the period of time.

30. The non-transitory computer readable storage medium of claim 29, wherein plotting the change in pressure over the period of time against the change in temperature over the period of time further comprises:

determining a linear best fit line using a linear regression algorithm.

31. The non-transitory computer readable storage medium of claim 30, the method further comprising;

measuring the pressure and temperature at a second time; and comparing the pressure and temperature measured at the second time with the linear best fit line.

32. The non-transitory computer readable storage medium of claim 31, wherein comparing the pressure and temperature measured at the second time with the linear best fit line further comprises:

determining that the pressure integrity of the component has been compromised if the pressure and temperature measured at the second time is below the linear best fit line.

33. The non-transitory computer readable storage medium of claim 31, wherein comparing the pressure and temperature measured at the second time with the linear best fit line further comprises:

determining that the pressure integrity of the component has not been compromised if the pressure and temperature measured at the second time is along or near the linear best fit line.

34. The non-transitory computer readable storage medium of claim 31, wherein comparing the pressure and temperature measured at the second time with the linear best fit line further comprises:

determining a presence of an external non-representative pressurization source if the pressure and temperature measured at the second time is above the linear best fit line.

35. A well system comprising:

a blowout preventer stack comprising a plurality of sealing members that can be actuated between an open position and a closed position;

one or more supply lines in fluid communication with the blowout preventer stack;

one or more temperature sensors and one or more pressure sensors arranged in proximity to the blowout preventer stack to measure a temperature and a pressure, respectively, of a test area in the blowout preventer stack; and a computer in communication with components of the blowout preventer stack, the one or more temperature sensors, and the one or more pressure sensors, wherein the computer is configured to perform a method comprising:

isolating the test area and a supply line to the test area from other components of the blowout preventer stack;

pressurizing the test area and the supply line to a test pressure with a test fluid;

measuring, over a period of time, a pressure and a temperature of the test fluid in the test area that was pressurized;

analyzing the pressure and the temperature that were measured for changes or absence of changes in the pressure, the temperature, or both the pressure and the temperature correlated to the state of the component's pressure integrity; and determining a pressure integrity of the test area based on the analysis.

36. The well system of claim 35, wherein analyzing the pressure and the temperature that were measured comprises:

determining a change in pressure over the period of time;

determining a change in temperature over the period of time; and plotting the change in pressure over the period of time against the change in temperature over the period of time.

37. The well system of claim 36, wherein plotting the change in pressure over the period of time against the change in temperature over time further comprises:

determining a linear best fit line using a linear regression algorithm.

38. The well system of claim 37, the method further comprising:

measuring the pressure and temperature at a second time; and comparing the pressure and temperature measured at the second time with the linear best fit line.

39. The well system of claim 38, wherein comparing the pressure and temperature measured at the second time with the linear best fit line further comprises:

determining that the pressure integrity of the component has been compromised if the pressure and temperature measured at the second time is below the linear best fit line.

40. The well system of claim 38, wherein comparing the pressure and temperature measured at the second time with the linear best fit line further comprises:

determining that the pressure integrity of the component has not been compromised if the pressure and temperature measured at the second time is along or near the linear best fit line.

41. The well system of claim 38, wherein comparing the pressure and temperature measured at the second time with the linear best fit line further comprises:

determining a presence of an external non-representative pressurization source if the pressure and temperature measured at the second time is above the linear best fit line.

* * * * *